US010394152B2

(12) United States Patent
Murai

(10) Patent No.: US 10,394,152 B2
(45) Date of Patent: Aug. 27, 2019

(54) TONER, TONER CONTAINER, DEVELOPING UNIT, AND IMAGE FORMING APPARATUS

(71) Applicant: Oki Data Corporation, Tokyo (JP)

(72) Inventor: Satoru Murai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/949,260

(22) Filed: Apr. 10, 2018

(65) Prior Publication Data

US 2018/0341191 A1 Nov. 29, 2018

(30) Foreign Application Priority Data

May 29, 2017 (JP) ..... 2017-105198

(51) Int. Cl.

| | |
|---|---|
| ***G03G 9/097*** | (2006.01) |
| ***G03G 15/08*** | (2006.01) |
| ***G03G 9/093*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/09725* (2013.01); *G03G 9/0825* (2013.01); *G03G 9/08755* (2013.01); *G03G 9/0926* (2013.01); *G03G 9/09342* (2013.01); *G03G 9/09371* (2013.01); *G03G 9/09708* (2013.01); *G03G 15/0865* (2013.01); *G03G 2215/0607* (2013.01)

(58) Field of Classification Search

CPC ..... G03G 9/09725; G03G 9/09708; G03G 9/0825; G03G 9/0926

USPC ..... 430/108.7, 108.6, 110.1

See application file for complete search history.

(56) References Cited

U.S. PATENT DOCUMENTS

2015/0072279 A1* 3/2015 Kuwabara ..... G03G 9/0806 430/105

FOREIGN PATENT DOCUMENTS

JP 2015-055736 A 3/2015

* cited by examiner

*Primary Examiner* — Janis L Dote

(74) *Attorney, Agent, or Firm* — Rabin & Berdo, P.S.

(57) ABSTRACT

A toner includes an external additive particle that is a complex oxide containing a titanium dioxide ($TiO_2$) and a silicon dioxide ($SiO_2$). A detection amount of titanium (Ti) detected through an elementary analysis based on energy-dispersive X-ray spectrometry is equal to or higher than about 0.590 percent by weight and equal to or lower than about 0.967 percent by weight.

7 Claims, 3 Drawing Sheets

TONER, TONER CONTAINER, DEVELOPING UNIT, AND IMAGE FORMING APPARATUS

CROSS REFERENCE TO RELATED APPLICATIONS

The present application claims priority from Japanese Patent Application No. 2017-105198 filed on May 29, 2017, the entire contents of which are hereby incorporated by reference.

BACKGROUND

The technology relates to a toner including an external additive particle and relates to a toner container, a developing unit, and an image forming apparatus in each of which the toner is used.

An image forming apparatus using an electrophotographic scheme is in widespread use. One reason for this is that the image forming apparatus using the electrophotographic scheme is able to achieve a high-quality image in a short time, compared with an image forming apparatus using other scheme such as an inkjet scheme.

The image forming apparatus using the electrophotographic scheme is provided with a developing unit that includes a toner container. The toner container contains a toner to be used to form an image. The developing unit attaches the toner contained in the toner container to a latent image.

Various proposals have been made already for a configuration of the toner to be used in the image forming apparatus of the electrophotographic scheme. For example, two types of external additive particles are used in combination to suppress an occurrence of a printing blur, for example, as disclosed in Japanese Unexamined Patent Application Publication No. 2015-055736. One of the external additive particles is a complex oxide particle containing a titanium dioxide and a silicon dioxide, and the other one of the external additive particles is a melamine resin particle.

SUMMARY

Specific consideration has been given to formation of a high-quality image regarding a configuration of a toner. However, the formation of the high-quality image has not been achieved sufficiently yet, which still leaves room for improvement.

It is desirable to provide a toner, a toner container, a developing unit, and an image forming apparatus that are able to form a high-quality image.

According to one embodiment of the technology, there is provided a toner including an external additive particle that is a complex oxide containing a titanium dioxide ($TiO_2$) and a silicon dioxide ($SiO_2$). A detection amount of titanium (Ti) detected through an elementary analysis based on energy-dispersive X-ray spectrometry is equal to or higher than about 0.590 percent by weight and equal to or lower than about 0.967 percent by weight.

According to another embodiment of the technology, there is provided a toner container that includes a toner, and a toner containing receptacle. The toner includes an external additive particle that is a complex oxide containing a titanium dioxide and a silicon dioxide. The toner containing receptacle contains the toner. A detection amount of titanium detected through an elementary analysis, of the toner, based on energy-dispersive X-ray spectrometry is equal to or higher than about 0.590 percent by weight and equal to or lower than about 0.967 percent by weight.

According to yet another embodiment of the technology, there is provided a developing unit that includes a toner container and a toner attaching section. The toner container contains a toner. The toner includes an external additive particle that is a complex oxide containing a titanium dioxide and a silicon dioxide. The toner attaching section attaches the toner contained in the toner container to a latent image. A detection amount of titanium detected through an elementary analysis, of the toner, based on energy-dispersive X-ray spectrometry is equal to or higher than about 0.590 percent by weight and equal to or lower than about 0.967 percent by weight.

According to still another embodiment of the technology, there is provided an image forming apparatus that includes a developing unit, a transfer unit, and a fixing unit. The developing unit includes a toner container and a toner attaching section. The toner container contains a toner. The toner attaching section attaches the toner contained in the toner container to a latent image. The toner includes an external additive particle that is a complex oxide containing a titanium dioxide and a silicon dioxide. The transfer unit transfers, onto a print medium, the toner attached to the latent image by the developing unit. The fixing unit fixes, to the print medium, the toner transferred onto the print medium by the transfer unit. A detection amount of titanium detected through an elementary analysis, of the toner, based on energy-dispersive X-ray spectrometry is equal to or higher than about 0.590 percent by weight and equal to or lower than about 0.967 percent by weight.

DETAILED DESCRIPTION

Figure 1:
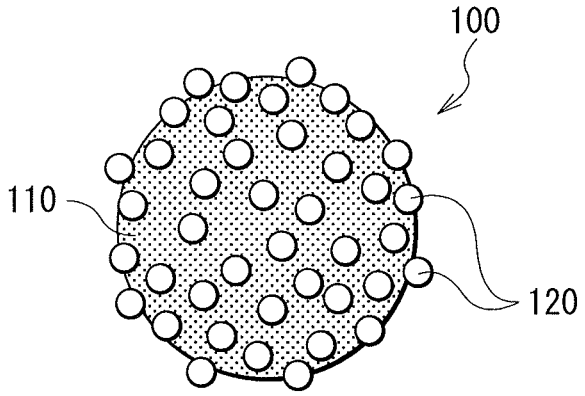
FIG. 1 is a plan view schematically illustrating an example of a configuration of a toner according to one example embodiment of the technology.

Some example embodiments of the technology are described in detail below in the following order with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis.

The drawings are schematic and are not intended to be drawn to scale. Note that the like elements are denoted with the same reference numerals, and any redundant description thereof will not be described in detail.

1. Toner
1-1. General Configuration
1-2. Configuration of Toner Base Particle
1-3. Configuration of External Additive Particle
1-4. Element Detection Condition for External Additive Particle
1-5. Manufacturing Method
1-6. Workings and Effects
2. Image Forming Apparatus (Toner Container and Developing Unit)
2-1. General Configuration
2-2. Configuration of Developing Unit
2-3. Operation
2-4. Workings and Effects
3. Modification Examples

1. TONER

A description is given first of a toner according to an example embodiment of the technology.

The toner according to an example embodiment of the technology may be used in an image forming apparatus of an electrophotographic scheme, for example. Hereinafter, the toner according to an example embodiment of the technology is referred to simply as the toner. In one example, the toner described herein may be used in a developing process performed by a developing unit provided in an image forming apparatus, for example. A description is given later of the developing process.

In the image forming apparatus, a toner may be fixed to a print medium for image formation, and thus an image may be formed on a surface of the print medium. Hereinafter, the print medium for image formation is referred to simply as the print medium. A detailed description is given later of each of the image forming apparatus and the print medium with reference to FIG. 3 and FIG. 4.

The toner may be a negatively-charged toner of a single component development method, for example. In other words, the toner may have a negative charging polarity, for example.

The single component development method provides the toner itself with an appropriate amount of electric charge without using a carrier, i.e., a magnetic particle, to apply an electric charge to the toner. In contrast, a two component development method provides the toner with an appropriate amount of electric charge by utilizing friction between the foregoing carrier and the toner owing to the use of the foregoing carrier.

The type, e.g., the color, of the toner is not particularly limited. Thus, non-limiting examples of the toner may include a color toner and a spot color toner.

The color toner is a toner used to color a print medium when a color image is to be formed on a surface of the print medium. In other words, the color toner is to color a print medium in a desired color and may thus contain a coloring material, i.e., a colorant. Non-limiting examples of the color toner may include a yellow toner, a magenta toner, a cyan toner, a black toner, and a white toner.

Meanwhile, unlike the color toner described above, the spot color toner is a toner to be used for a purpose other than coloring a print medium. In other words, the spot color toner is not to color a print medium in a desired color and may thus not contain the aforementioned colorant. Non-limiting examples of the spot color toner may include a transparent toner. The transparent toner may also be referred to as a clear toner.

[1-1. General Configuration]

A description is given first of a general configuration of a toner 100, serving as the toner according to an example embodiment of the technology.

FIG. 1 schematically illustrates an example of a planar configuration of the toner 100. As illustrated in FIG. 1, the toner 100 may include a toner base particle 110 and an external additive particle 120, for example.

[Toner Base Particle]

The toner base particle 110 may mainly be a main portion of the toner 100. The toner base particle 110 may include one or more of materials such as a binder resin. The composition of the toner base particle 110 may differ in accordance with the type of the toner 100. For example, the stated composition may differ depending on whether the toner 100 is a color toner or a spot color toner. A description is given later of the composition of the toner base particle 110.

The three-dimensional shape of the toner base particle 110 is not particularly limited. For example, the three-dimensional shape of the toner base particle 110 may be one or more of shapes such as a substantially spherical shape.

[External Additive Particle]

The external additive particle 120 may mainly suppress a phenomenon such as aggregation in the toner 100, and thereby improve fluidity of the toner 100. The external additive particle 120 may be attached, for example, on a surface of the toner base particle 110.

The three-dimensional shape of the external additive particle 120 is not particularly limited. For example, similarly to the toner base particle 110 described above, the three-dimensional shape of the external additive particle 120 may be one or more of shapes such as a substantially spherical shape. In addition, the number of the external additive particle 120 is not particularly limited. For example, one or more external additive particles 120 may be provided. In one example, the external additive particle 120 may take a form of a plurality of substantially spheres.

The manner in which the plurality of external additive particles 120 are distributed over the surface of the toner base particle 110 is not particularly limited. In one example, the plurality of external additive particle 120 may be as dispersed sufficiently. One reason for this is that the external additive particle 120 may more easily suppress a phenomenon such as aggregation in the toner 100.

Referring to FIG. 1, the toner base particle 110 is hatched to make it easier to distinguish between the toner base particle 110 and the external additive particle 120. A description is given later of a detailed configuration of each of the toner base particle 110 and the external additive particle 120.

[1-2. Configuration of Toner Base Particle]

A description is given next of a detailed configuration of the toner base particle 110 illustrated in FIG. 1.

The toner base particle 110 may include one or more of materials such as a binder resin, for example. As described above, the composition of the toner base particle 110 may differ in accordance with the type of the toner 100, for example. For example, the stated composition may differ depending on whether the toner 100 is a color toner or a spot color toner.

[Toner Base Particle of Color Toner]

The toner base particle 110 of a color toner may include a colorant in addition to the aforementioned binder resin, for example. The toner base particle 110 may further include one or more of other materials, for example. The types of the other materials are not particularly limited. Non-limiting examples of the other materials may include a release agent, an electric charge control agent, an electric conductivity modifier, a reinforcement filler, an antioxidant, an antistaling agent, a flow improver, and a cleaning improver.

[Colorant]

The colorant may mainly color the toner 100 in a desired color. The colorant may include one or more of coloring materials in colors corresponding to the color of the toner 100.

The colorant included in the yellow toner may include a coloring material such as a yellow pigment, for example. The type of the yellow pigment is not particularly limited, and non-limiting examples of the yellow pigment may include Pigment Yellow 74.

The colorant included in the magenta toner may include a coloring material such as a magenta pigment, for example. The type of the magenta pigment is not particularly limited, and non-limiting examples of the magenta pigment may include Pigment Red 122 and quinacridone.

The colorant included in the cyan toner may include a coloring material such as a cyan pigment, for example. The type of the cyan pigment is not particularly limited, and non-limiting examples of the cyan pigment may include Copper Pigment Blue 15:3 and phthalocyanine.

The colorant included in the black toner may include a coloring material such as a black pigment, for example. The type of the black pigment is not particularly limited, and non-limiting examples of the black pigment may include carbon black.

The colorant included in the white toner may include a coloring material such as a white pigment, for example. The type of the white pigment is not particularly limited, and non-limiting examples of the white pigment may include a titanium oxide.

It is to be noted that the colorant may include coloring materials of two or more colors to adjust the color of the toner 100 to a desired color. In other words, the color toner may be a toner of a color other than the above-described five colors, i.e., yellow, magenta, cyan, black, and white.

[Binder Resin]

The binder resin may mainly bind a series of materials included in the toner base particle 110 with each other. The binder resin may include one or more of polymer compounds, for example. The types of the polymer compounds are not particularly limited. Non-limiting examples of the polymer compounds may include polyester-based resin, styrene-acrylic resin, epoxy-based resin, vinyl-based resin, polyamide-based resin, polyurethane-based resin, and styrene-butadiene-based resin.

The polyester-based resin is a collective term for polyester resin and derivatives thereof. A derivative of the polyester resin is polyester resin in which any one or more substituents are introduced. There may be only one type of substituent or two or more types of substituents.

The definition given for the derivatives with the polyester-based resin serving as an example may apply in a similar manner to each of the styrene-acrylic resin, the epoxy-based resin, the vinyl-based resin, the polyamide-based resin, the polyurethane-based resin, and the styrene-butadiene-based resin.

In one example, the binder resin may include the polyester-based resin. One reason for this is that the following advantages may be obtained. One reason for the above is that the polyester-based resin has high affinity for the print medium such as paper, and the toner 100 is therefore easily fixed to the print medium such as paper. Another reason is that the polyester-based resin has high physical strength even with a relatively-small molecular weight, and the toner 100 therefore has high durability. Still another reason is that the toner 100 is fixed to the print medium more easily even when the toner 100 has low electric charge characteristics.

The crystalline state of the polyester-based resin is not particularly limited. Therefore, the polyester-based resin may be crystalline polyester-based resin, amorphous polyester-based resin, or both, or may be polyester-based resin including both a crystalline portion and an amorphous portion. In one example, the polyester-based resin may be the crystalline polyester-based resin. One reason for this is that the toner 100 is thereby fixed to the print medium more easily, and the durability of the toner 100 is thereby improved.

The polyester-based resin may be a reactant, i.e., a condensation polymer, of one or more alcohols and one or more carboxylic acids, for example.

The type of the alcohol is not particularly limited. In one example, the alcohol may be an alcohol having a valence of two or greater or a derivative thereof. Non-limiting examples of the alcohol having the valence of two or greater may include ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, and glycerin.

The type of the carboxylic acid is not particularly limited. In one example, however, the carboxylic acid may be a carboxylic acid having a valence of two or greater or a derivative thereof. Non-limiting examples of the carboxylic acid having the valence of two or greater may include maleic acid, fumaric acid, phthalic acid, isophthalic acid, terephthalic acid, succinic acid, adipic acid, trimellitic acid, pyromellitic acid, cyclopentane dicarboxylic acid, succinic anhydride, trimellitic anhydride, maleic anhydride, and dodecenylsuccinic anhydride.

[Release Agent]

The release agent may mainly improve characteristics, of the toner 100, such as fixing characteristics and offset resistance. The release agent may include one or more of waxes, for example. The type of the wax is not particularly limited. Non-limiting examples of the wax may include aliphatic-hydrocarbon-based wax, an oxide of aliphatic-hydrocarbon-based wax, fatty-acid-ester-based wax, a deoxide of fatty-acid-ester-based wax, and a block copolymer of two or more of the foregoing series of waxes.

Non-limiting examples of the aliphatic-hydrocarbon-based wax may include low-molecular polyethylene, low-molecular polypropylene, a copolymer of olefin, microcrystalline wax, paraffin wax, and Fischer-Tropsch wax. Non-limiting examples of the oxide of aliphatic-hydrocarbon-based wax may include oxidized polyethylene wax. Non-limiting examples of the fatty-acid-ester-based wax may include carnauba wax and montanic acid ester wax. The deoxide of fatty-acid-ester-based wax may be partially-deoxidized or fully-deoxidized fatty-acid-ester-based wax. Non-limiting examples of the deoxide of fatty-acid-ester-based wax may include deoxidized carnauba wax.

[Electric Charge Control Agent]

The electric charge control agent may mainly control characteristics such as triboelectric charging characteristics of the toner 100. The electric charge control agent to be used for the negatively-charged toner may include one or more of complexes, for example. The type of the complex is not particularly limited. Non-limiting examples of the complex may include an azo-based complex, a salicylic-acid-based complex, and a calixarene-based complex.

[Other Materials]

It is to be note that the material for each of the electric conductivity modifier, the reinforcement filler, the antioxidant, the antistaling agent, the flow improver, and the cleaning improver is not particularly limited, and any material may be used.

[Toner Base Particle of Spot Color Toner]

The toner base particle 110 of a spot color toner may have a configuration similar to that of the toner base particle 110 of the color toner described above, except in that the toner base particle 110 of the spot color toner includes no colorant, for example. In other words, the toner base particle 110 may include a binder resin, for example. The toner base particle 110 may further include one or more of the release agent, the electric charge control agent, the electric conductivity modifier, the reinforcement filler, the antioxidant, the antistaling agent, the flow improver, and the cleaning improver, for example.

[1-3. Configuration of External Additive Particle]

A description is given next of a detailed configuration of the external additive particle 120 illustrated in FIG. 1.

Figure 2:
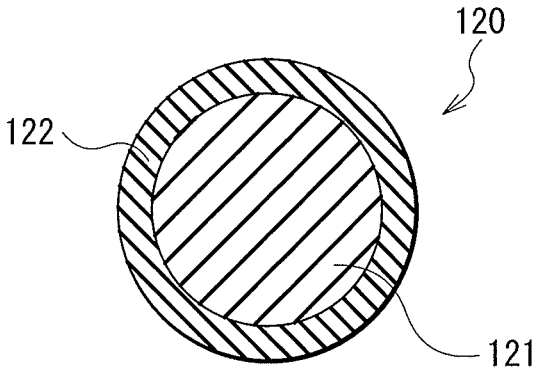
FIG. 2 is a cross-sectional view illustrating, in an enlarged fashion, an example of a configuration of an external additive particle illustrated in FIG. 1.

FIG. 2 illustrates, in an enlarged fashion, an example of a cross-sectional configuration of the external additive particle 120 illustrated in FIG. 1. FIG. 2 illustrates, for example, one external additive particle 120 among the plurality of external additive particles 120.

The external additive particle 120 contains two types of oxides. More specifically, the external additive particle 120 is a complex oxide that contains a titanium dioxide and a silicon dioxide. The configuration of the external additive particle 120 is not particularly limited as long as the external additive particle 120 is the complex oxide that contains a titanium dioxide and a silicon dioxide as described above and satisfies an element detection condition for the external additive particle 120. A description is given later of the element detection condition for the external additive particle 120.

In one example, as illustrated in FIG. 2, the external additive particle 120 may be a complex oxide particle that includes a center portion 121 and a cover portion 122, for example. One reason for this is that the element detection condition for the external additive particle 120 may more easily be satisfied.

[Center Portion]

The center portion 121 may contain a titanium dioxide, i.e., titania, for example. The three-dimensional shape of the center portion 121 is not particularly limited and may be a substantially spherical shape, for example.

It is to be noted that the center portion 121 may contain a silicon dioxide in addition to a titanium dioxide, for example. In a case where the center portion 121 contains a silicon dioxide in addition to a titanium dioxide, a primary component of the center portion 121 may be the titanium dioxide. In other words, the content of the titanium dioxide in the center portion 121 may be sufficiently greater than the content of the silicon dioxide in the center portion 121.

[Cover Portion]

The cover portion 122 may be an outer portion, of the external additive particle 120, that covers the surface of the center portion 121. This cover portion 122 may contain a silicon dioxide, i.e., silica, for example.

It is to be noted that the cover portion 122 may cover a portion of the surface of the center portion 121 or may cover all of the surface of the center portion 121, for example. In a case where the cover portion 122 covers a portion of the surface of the center portion 121, the cover portion 122 may cover the surface of the center portion 121 at a plurality of sites spaced apart from each other. FIG. 2 illustrates an example case where the cover portion 122 covers all of the surface of the center portion 121.

The cover portion 122 may contain a titanium dioxide in addition to a silicon dioxide, for example. In a case where the cover portion 122 contains a titanium dioxide in addition to a silicon dioxide, a primary component of the cover portion 122 may be the silicon dioxide. In other words, the content of the silicon dioxide in the cover portion 122 may be sufficiently greater than the content of the titanium dioxide in the cover portion 122.

The thickness of the cover portion 122 is not particularly limited and may be set as desired.

[Other External Additive Particles]

The toner 100 may include, in addition to the external additive particle 120 described above, one or more of other external additive particles, for example. The other external additive particles may be attached to the surface of the toner base particle 110, for example, in a similar manner to the external additive particle 120.

The types of the other external additive particles are not particularly limited. Non-limiting examples of the other external additive particles may include an inorganic particle (excluding the complex oxide particle described above) and an organic particle. Non-limiting examples of the inorganic particle may include a titanium dioxide, a silicon dioxide, an aluminum oxide ($Al_2O_3$), and colloidal silica. The titanium dioxide and the silicon dioxide as described herein may be regular particles, i.e., a titanium dioxide particle and a silicon dioxide particle, different from the complex oxide particle described above. Non-limiting examples of the organic particle may include melamine resin. The details regarding the three-dimensional shape of the other external additive particles may be similar to the details regarding the three-dimensional shape of the external additive particle 120, for example.

[1-4. Element Detection Condition for External Additive Particle]

A description is given next of the element detection condition for the external additive particle 120.

[Element Detection Condition for External Additive Particle]

In the toner 100, the element detection condition for the external additive particle 120 may be made appropriate to improve the toner characteristics in a case where the external additive particle 120 is a complex oxide that contains the titanium dioxide and the silicon dioxide described above is used.

The toner characteristics as described herein may mainly include glossiness of an image formed by the use of the toner 100 and a bias responsiveness of the toner 100. In addition, the term "element" in the element detection condition for the external additive particle 120 may indicate titanium included in the titanium dioxide described above.

The detection amount of titanium detected through an elementary analysis of the toner 100 performed by the use of energy-dispersive X-ray spectrometry (EDX) may be from about 0.590 wt % to about 0.967 wt %.

The detection amount of titanium may be measured by subjecting the surface of the toner 100 to an elementary analysis by the use of the EDX, as described above. In the elementary analysis performed by the use of the EDX, for example, an energy-dispersive X-ray fluorescence spectrometer with the trade name EDX-800HS available from Shimadzu Corporation, Kyoto, Japan may be used. In this case, for example, an analysis environment may be in a helium (He) gas atmosphere, and the X-ray tube voltage may be 15 kV and 50 kV.

One reason why the detection amount of titanium is within the aforementioned range is that, as the attachment amount of the external additive particle 120 attached to the toner base particle 110 is made appropriate, the glossiness of an image may improve while the bias responsiveness of the toner 100 is being ensured.

In detail, in a case where the detection amount of titanium is less than about 0.590 wt %, the attachment amount of the external additive particle 120 may be too small. Thus, although the bias responsiveness of the toner 100 may improve, the glossiness of the image may decrease.

Meanwhile, in a case where the detection amount of titanium is greater than about 0.967 wt %, the attachment amount of the external additive particle 120 may be too large. Thus, although the glossiness of image may improve, the bias responsiveness of the toner 100 may decrease. One conceivable reason why the bias responsiveness of the toner 100 may decrease is that the titanium dioxide is charged less easily. In other words, when the detection amount of titanium is too large, i.e., when the content of the titanium dioxide is too large, the toner 100 is charged less easily, and the toner 100 is less likely to move electrically.

In contrast, when the detection amount of titanium is within the range described above, the attachment amount of the external additive particle 120 may be made appropriate. Thus, the bias responsiveness of the toner 100 may improve, and the glossiness of the image may also improve. In other words, improvement in the bias responsiveness and improvement in the glossiness may both be achieved.

[Weight of External Additive Particle]

The weight of the external additive particle 120 may be made appropriate in accordance with the element detection condition for the external additive particle 120 described above.

In one example, a rate (weight rate) W of a weight W2 of the external additive particle 120 relative to a weight W1 of the toner base particle 110 may be from about 1.6 wt % to about 2.5 wt %. One reason for this is that, as the weight W2 of the external additive particle 120 relative to the weight W1 of the toner base particle 110 is made appropriate, the element detection condition for the external additive particle 120 described above may be more easily satisfied. The weight rate W described above may be calculated through an equation $W=(W2/W1)\times 100$.

[Suitable Toner Type]

As described above, the type, e.g., the color, of the toner 100 is not particularly limited. Thus, the toner 100 may be a color toner or a spot color toner.

In one example, the toner 100 may be a spot color toner, e.g., a transparent toner, that includes no colorant. One reason for this is that an image formed by the use of a transparent toner may be expected to excel in glossiness, and satisfying the element detection condition for the external additive particle 120 described above may provide sufficient glossiness.

The transparent toner as described herein may be a toner having a transmittance measured under the test condition described below of equal to or higher than about 80%, for example. In other words, the transmittance obtained when the toner 100 is irradiated with test light in a state in which the toner 100 is placed on a surface of a substrate may be equal to or higher than about 80%. One reason for this it that, as the element detection condition for the external additive particle 120 described above is satisfied, necessary and sufficient glossiness may be obtained. It is possible to measure the stated transmittance by using any transmittance measuring device, for example.

[Test Condition]

Substrate: OHP film (with the trade name CG 3700 available from 3M, St. Paul, Minn., USA).

Attachment amount: 0.70 mg/cm$^2$

Wavelength of test light: equal to or longer than 430 nm and equal to or shorter than 740 nm

[1-5. Manufacturing Method]

A description is given next of a method of manufacturing the toner 100.

The method of manufacturing the toner 100 is not particularly limited. Specific but non-limiting examples of the method of manufacturing the toner 100 may include pulverization and polymerization. The method of manufacturing the toner 100 may also be any other method. Two or more of the foregoing methods may be used in any combination. Non-limiting examples of the polymerization may include an emulsion polymerization aggregation method and a solution suspension method.

Below, a description is given of a method of manufacturing the toner 100 by the use of the solution suspension method, for example.

[Preparation of Continuous Phase]

To manufacture the toner 100 by the use of the solution suspension method, first, a continuous phase, i.e., an aqueous phase, may be prepared.

In one example, an inorganic dispersant, e.g., a suspension stabilizer, may be added to an aqueous solvent, and this aqueous solvent may be then stirred to dissolve or disperse the suspension stabilizer. In this case, a device such as a stirrer may be used to stir the aqueous solvent, or the aqueous solvent may be heated. Conditions such as the stirring speed and the stirring time may be set as desired.

The type of the aqueous solvent is not particularly limited. Non-limiting examples of the aqueous solvent may include one or more of materials such as pure water. The type of the suspension stabilizer is not particularly limited. Non-limiting examples of the suspension stabilizer may include one or more of trisodium phosphate, calcium carbonate, calcium chloride, sodium hydrocarbon, potassium hydrocarbon, hydroxyapatite, and calcium phosphate and may also include a hydrate of the foregoing materials.

[Preparation of Dispersed Phase]

A dispersed phase, i.e., an oil phase, may then be prepared.

In one example, a binder resin may be added to an organic solvent, and this organic solvent may be then stirred to dissolve or disperse the binder resin. In this case, a device such as a stirrer may be used to stir the organic solvent, or the organic solvent may be heated. Conditions such as the stirring speed and the stirring time may be set as desired.

The type of the organic solvent is not particularly limited. Non-limiting examples of the organic solvent may include one or more of a hydrocarbon-based solvent, an ester-based solvent, an ether-based solvent, and a ketone-based solvent. Non-limiting examples of the hydrocarbon-based solvent may include xylene and hexane. Non-limiting examples of the ester-based solvent may include methyl acetate, ethyl acetate, butyl acetate, and isopropyl acetate. Non-limiting examples of the ether-based solvent may include diethyl ether. Non-limiting examples of the ketone-based solvent may include acetone, methyl ethyl ketone, diisobutyl ketone, cyclohexanone, and methylcyclohexane.

It is to be note that, in addition to the organic solvent and the binder resin, one or more of the other materials such as the colorant and the release agent described above may be added.

[Granulation]

Granulation may then be performed by the use of the continuous phase and the dispersed phase described above to fabricate the toner base particle 110.

In one example, first, the dispersed phase may be mixed into the continuous phase, and this mixture may then be stirred. Thus, the mixture may be suspended and granulated, and a slurry solution including the granulated product may thus be obtained. In this case, a device such as a stirrer may be used to stir the mixture, or the mixture may be heated. Conditions such as the stirring speed and the stirring time may be set as desired.

Thereafter, the slurry solution may be distilled under a reduced pressure, and thus the organic solvent included in the slurry solution may be volatilized and removed. Thereafter, a pH regulator may be added to the slurry solution, and the slurry solution may thereafter be filtered to dissolve and remove the suspension stabilizer included in the slurry solution. The type of the pH regulator is not particularly limited. Non-limiting examples of the pH regulator may include acid such as nitric acid.

Thereafter, the granulated product may be dehydrated to collect the granulated product. Then, the granulated product may be redispersed in an aqueous solvent. Thereafter, the granulated product may be washed with an aqueous solvent, and thereafter, the granulated product may be filtered. Details of the aqueous solvent may be as described above, for example.

Lastly, the granulated product may be dehydrated and dried, and the granulated product may be classified thereafter. Thus, the toner base particle 110 may be obtained.

[External Addition Process]

Lastly, the toner base particle 110 may be subjected to an external addition process.

In one example, the external additive particle 120 may be mixed into the toner base particle 110, and this mixture may be stirred thereafter. In this case, a device such as a stirrer may be used to stir the mixture. Conditions such as the stirring speed and time of the mixture may be set as desired. The mixture ratio, i.e., the weight ratio, between the toner base particle 110 and the external additive particle 120 may be as described above. In other words, the mixture ratio between the toner base particle 110 and the external additive particle 120 may be set to satisfy the condition pertaining to the weight rate W described above, for example.

Thus, the external additive particle 120 may be attached to the surface of the toner base particle 110. Thus, the toner 100 may be completed.

[1-6. Workings and Effects]

According to the toner 100, the external additive particle 120 is a complex oxide that contains a titanium dioxide and a silicon dioxide, and the element detection condition for the external additive particle 120 described above may be satisfied. The stated element detection condition may be that the detection amount of titanium is from about 0.590 wt % to about 0.967 wt %. In this case, as described above, the attachment amount of the external additive particle 120 attached to the toner base particle 110 may be made appropriate. Therefore, the glossiness of the image formed by the use of the toner 100 may improve while the bias responsiveness of the toner 100 is ensured. Accordingly, an image that excels in glossiness may be formed by the use of the toner 100 in a necessary and sufficient amount, and it is therefore possible to form a high-quality image.

For example, if the external additive particle 120 includes the center portion 121 containing a titanium dioxide and the cover portion 122 containing a silicon dioxide, the element detection condition for the external additive particle 120 described above may more easily be satisfied, and it is therefore possible to obtain a higher effect.

In addition, if the weight rate W of the weight W2 of the external additive particle 120 relative to the weight W1 of the toner base particle 110 is from about 1.6 wt % to about 2.5 wt %, the element detection condition for the external additive particle 120 described above may more easily be satisfied, and it is therefore possible to obtain a higher effect.

Further, if the toner 100 is a transparent toner, an image formed by the use of the transparent toner is expected to excel in glossiness, and it is therefore possible to obtain a higher effect. In this case, if the transmittance of the toner 100 measured under the test condition described above is equal to or higher than 80%, necessary and sufficient glossiness may be ensured, and it is therefore possible to obtain an even higher effect.

2. IMAGE FORMING APPARATUS (TONER CONTAINER AND DEVELOPING UNIT)

A description is given next of an image forming apparatus according to an example embodiment of the technology, in which the toner 100 described above is used.

A toner container according to an example embodiment of the technology and a developing unit according to an example embodiment of the technology may constitute a portion of the image forming apparatus described below. Thus, a description is also given below of the toner container and the developing unit.

Figure 3:
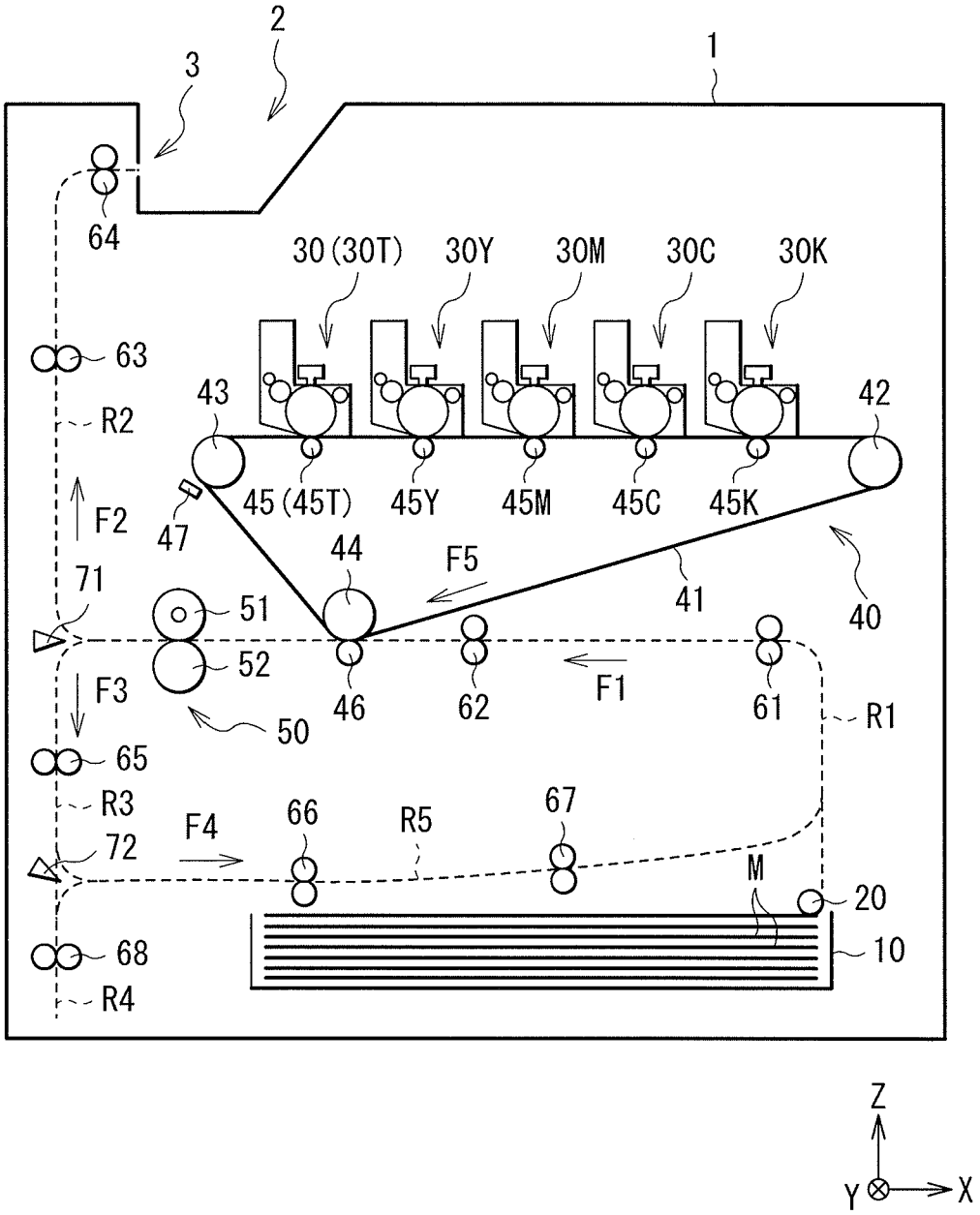
FIG. 3 is a plan view illustrating an example of a configuration of an image forming apparatus according to one example embodiment of the technology.
Figure 4:
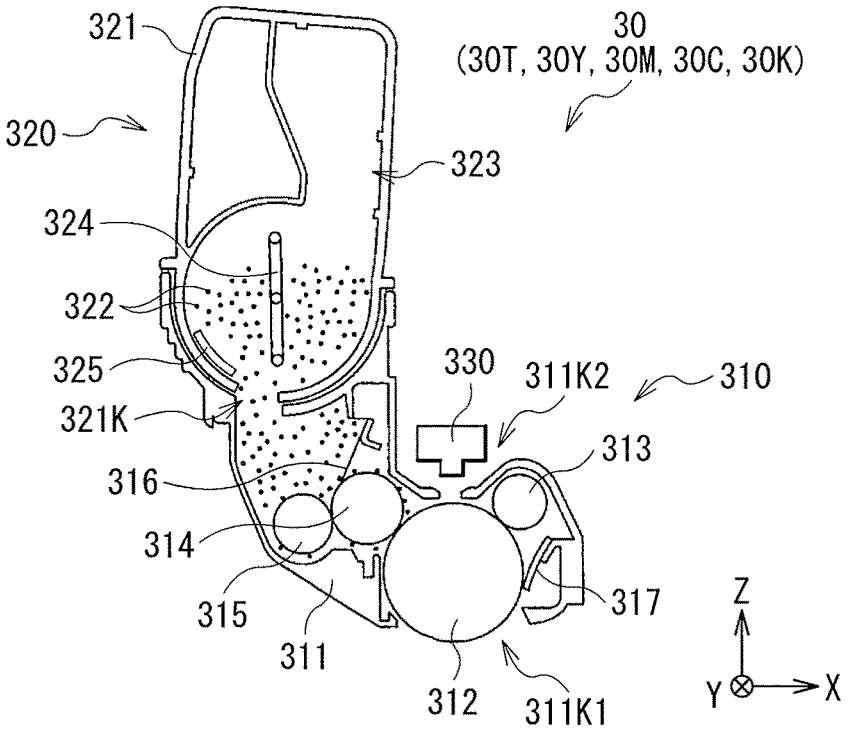
FIG. 4 is a plan view illustrating, in an enlarged fashion, an example of a configuration of a developing unit illustrated in FIG. 3.
Figure 5:
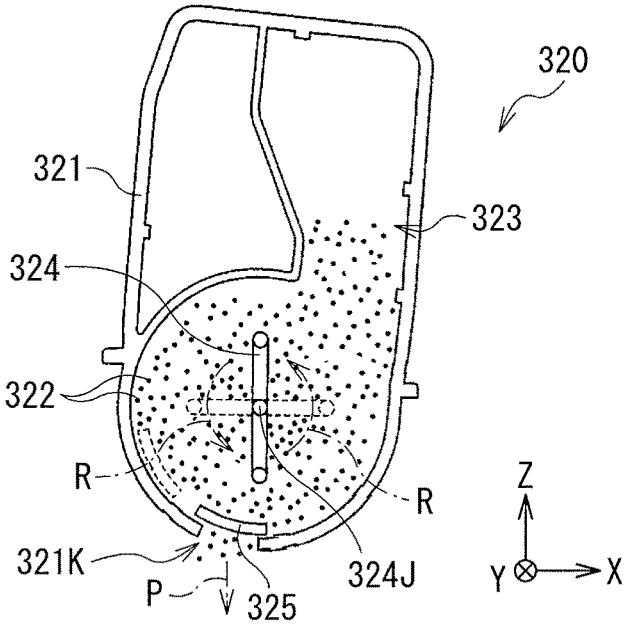
FIG. 5 is a plan view illustrating, in an enlarged fashion, an example of a configuration of a toner container illustrated in FIG. 4.

As described later, the image forming apparatus may, for example, be an apparatus that forms an image on a surface of a print medium M by the use of a toner 322. The image forming apparatus may be a full-color printer of a so-called electrophotographic scheme, as illustrated in FIG. 3 to FIG. 5.

The print medium M is not particularly limited in its material; however, the print medium M may include one or more of materials such as paper and a film, for example.

[2-1. General Configuration]

A description is given first of a general configuration of the image forming apparatus.

FIG. 3 illustrates an example of a planar configuration of the image forming apparatus. The image forming apparatus may involve conveyance of the print medium M along conveyance routes R1 to R5 in the process of forming an image. Each of the conveyance routes R1 to R5 is illustrated by a dashed line in FIG. 3.

The image forming apparatus described below may be an image forming apparatus of an intermediate-transfer scheme that uses an intermediate transfer medium, for example. Referring to FIG. 3, the image forming apparatus may include, inside a housing 1, a tray 10, a feeding roller 20, a developing unit 30, a transfer unit 40, a fixing unit 50, conveying rollers 61 to 68, and conveyance path switching guides 71 and 72, for example.

The image forming apparatus may be able to form an image only on one side of the print medium M and also able to form images on both sides of the print medium M, for example.

In the description below, when the image forming apparatus forms the image only on one side of the print medium M, the surface on which the image is to be formed is referred to as a "front surface" of the print medium M. Further, a surface, of the print medium M, opposite to the front surface is referred to as a "back surface" of the print medium M. When the image forming apparatus forms the images on both sides of the print medium M, the image is formed on each of the front surface and the back surface of the print medium M.

[Housing]

The housing 1 may include one or more of materials such as a metal material or a polymer material, for example. The housing 1 may be provided with a stacker 2 to which the print medium M provided with a formed image is to be discharged. The print medium M provided with the formed image may be discharged from a discharge opening 3 provided in the housing 1 to the stacker 2.

[Tray and Feeding Roller]

The tray 10 may be attached detachably to the housing 1, for example. The tray 10 may contain the print medium M, for example. The feeding roller 20 may be a cylindrical member that extends in a Y-axis direction and is rotatable around the Y-axis, i.e., a rotational axis, for example. Each of the members referred to by the name including the term "roller" out of a series of members described below may be a cylindrical member that extends in the Y-axis direction and is rotatable around the Y-axis, as with the feeding roller 20.

The tray 10 may contain a plurality of print media M in a stacked state, for example. The print media M contained in the tray 10 may be picked out one by one from the tray 10 by the feeding roller 20, for example.

The number of the tray 10 is not particularly limited, and may be only one or two or more. The number of the feeding roller 20 is not particularly limited, and may be only one or two or more. FIG. 3 illustrates an example case in which one tray 10 and one feeding roller 20 are provided.

[Developing Unit]

The developing unit 30 may mainly perform a process, i.e., a developing process, of attaching the toner 322 to a latent image, i.e., an electrostatic latent image. The toner 322 may be contained in a toner container 320. A description is given later of the toner container 320 with reference to FIGS. 4 and 5. For example, the developing unit 30 may form the electrostatic latent image, and attach the toner 322 to the electrostatic latent image by utilizing Coulomb force.

In this example, the image forming apparatus may include five developing units 30, i.e., developing units 30T, 30Y, 30M, 30C, and 30K.

The developing units 30T, 30Y, 30M, 30C, and 30K each may be attached detachably to the housing 1, and may be disposed along a traveling path of an intermediate transfer belt 41, which will be described later, for example. In this example, the developing units 30T, 30Y, 30M, 30C, and 30K may be disposed in this order from upstream toward downstream in a traveling direction, illustrated by an arrow F5, in which the intermediate transfer belt 41 travels.

The developing units 30T, 30Y, 30M, 30C, and 30K may each be movable between a standby position and a contact position, for example. When a photosensitive drum 312, described later with reference to FIG. 4, is located at the standby position, the photosensitive drum 312 may be recessed away from the intermediate transfer belt 41. Therefore, the photosensitive drum 312 may not be so pressed against a primary transfer roller 45, described later, as to be in contact with the primary transfer roller 45 with the intermediate transfer belt 41 in between. In contrast, when the photosensitive drum 312 is located at the contact position, the photosensitive drum 312 may be advanced toward the intermediate transfer belt 41. Therefore, the photosensitive drum 312 may be pressed against the primary transfer roller 45 while being applied with a pressure with the intermediate transfer belt 41 in between.

The developing units 30T, 30Y, 30M, 30C, and 30K may have configurations similar to each other, except for having toners 322 different in type, e.g., in color, from each other, for example. The toners 322 may each be contained in the toner container 320, which will be described later, for example.

In one example, the developing unit 30T may be provided with a toner 322, e.g., a transparent toner, which is a spot color toner, for example. The developing unit 30Y may be provided with a toner 322, e.g., a yellow toner, which is a color toner, for example. The developing unit 30M may be provided with a toner 322, e.g., a magenta toner, which is a color toner, for example. The developing unit 30C may be provided with a toner 322, e.g., a cyan toner, which is a color toner, for example. The developing unit 30K may be provided with a toner 322, e.g., a black toner, which is a color toner, for example.

The transparent toner may have a configuration similar to that of the toner, i.e., the spot color toner, according to an example embodiment of the technology described above. In addition, the yellow toner, the magenta toner, the cyan toner, and the black toner may each have a configuration similar to that of the toner, i.e., the color toner, according to an example embodiment of the technology described above.

A description is given later of a detailed configuration of each of the developing units 30T, 30Y, 30M, 30C, and 30K with reference to FIGS. 4 and 5.

[Transfer Unit]

The transfer unit 40 may mainly perform a transfer process of the toner 322 that has been subjected to the developing process by the developing unit 30. For example, the transfer unit 40 may transfer, onto the print medium M, the toner 322 attached to the electrostatic latent image by the developing unit 30.

The transfer unit 40 may include the intermediate transfer belt 41, a driving roller 42, a driven roller 43, a backup roller 44, the primary transfer roller 45, a secondary transfer roller 46, and a cleaning blade 47, for example.

[Intermediate Transfer Belt]

The intermediate transfer belt 41 may be an intermediate transfer medium onto which the toner 322 is temporarily transferred before the toner 322 is transferred onto the print medium M. The intermediate transfer belt 41 may be an elastic endless belt, for example. The intermediate transfer belt 41 may include one or more of polymer materials such as polyimide, for example. The intermediate transfer belt 41 may be able to travel in response to rotation of the driving roller 42, while lying on the driving roller 42, the driven roller 43, and the backup roller 44 in a stretched state, for example.

[Driving Roller, Driven Roller, and Backup Roller]

The driving roller 42 may be rotatable, for example, by means of a motor. Each of the driven roller 43 and the backup roller 44 may be rotatable in accordance with the rotation of the driving roller 42, for example.

[Primary Transfer Roller]

The primary transfer roller 45 may transfer, onto the intermediate transfer belt 41, the toner 322 attached to the electrostatic latent image. In other words, the primary transfer roller 45 may perform primary transfer. The primary transfer roller 45 may be so pressed against the developing unit 30 as to be in contact with the developing unit 30 with the intermediate transfer belt 41 in between. For example, the primary transfer roller 45 may be so pressed against the photosensitive drum 312 as to be in contact with the photosensitive drum 312 with the intermediate transfer belt 41 in between. The photosensitive drum 312 will be described later in greater detail with reference to FIG. 4.

The number of the provided primary transfer roller 45 is not particularly limited. Therefore, one primary transfer roller 45 may be provided, or two or more primary transfer rollers 45 may be provided. In this example, the transfer unit 40 may include five primary transfer rollers 45, i.e., primary transfer rollers 45T, 45Y, 45M, 45C, and 45K, corresponding to the five developing units 30, i.e., the developing units 30T, 30Y, 30M, 30C, and 30K, described above. The transfer unit 40 may also include one secondary transfer roller 46 corresponding to the one backup roller 44.

[Secondary Transfer Roller]

The secondary transfer roller 46 may transfer, onto the print medium M, the toner 322 that has been transferred onto the intermediate transfer belt 41. In other words, the secondary transfer roller 46 may perform secondary transfer. The secondary transfer roller 46 may be so pressed against the backup roller 44 as to be in contact with the backup roller 44. The secondary transfer roller 46 may include a metal core and an elastic layer, for example. The elastic layer may cover an outer peripheral surface of the metal core, for example. The metal core may include one or more of metal materials such as aluminum, for example. This feature regarding the material of the metal core may also apply in a similar manner hereinafter, for example. The elastic layer may include one or more of rubber materials such as foamed rubber, for example.

[Cleaning Blade]

The cleaning blade 47 may be a plate-like elastic member that scrapes off an unnecessary material such as unnecessary remains of the toner 322 on the surface of the intermediate transfer belt 41. The cleaning blade 47 may be so pressed against the intermediate transfer belt 41 as to be in contact with the intermediate transfer belt 41. The position of the cleaning blade 47 is not particularly limited. FIG. 3 illustrates an example case where the cleaning blade 47 is disposed in the vicinity of the driven roller 43.

[Fixing Unit]

The fixing unit 50 may mainly perform a fixing process of the toner 322 that has been transferred onto the print medium M by the transfer unit 40. For example, the fixing unit 50 may apply a pressure onto the print medium M onto which the toner 322 has been transferred by the transfer unit 40, while heating the print medium M. The fixing unit 50 may thereby fix the toner 322 to the print medium M.

The fixing unit 50 may include a heating roller 51 and a pressure applying roller 52, for example.

[Heating Roller]

The heating roller 51 may heat the toner 322. The heating roller 51 may include a metal core and a resin coating, for example. The resin coating may cover a surface of the metal core, for example. The resin coating may include one or more of polymer materials such as a copolymer of tetrafluoroethylene and perfluoroalkylvinylether (PFA), or polytetrafluoroethylene (PTFE), for example.

A heater may be disposed inside the heating roller 51, for example. The heater may be disposed inside the metal core of the heating roller 51, for example. The heater may include a halogen lamp, for example. A thermistor may be disposed in the vicinity of the heating roller 51, for example. The heating roller 51 and the thermistor may be spaced apart from each other. The thermistor may measure a surface temperature of the heating roller 51, for example.

[Pressure Applying Roller]

The pressure applying roller 52 may be so pressed against the heating roller 51 as to be in contact with the heating roller 51. The pressure applying roller 52 may apply a pressure onto the toner 322. The pressure applying roller 52 may include a metal core and a heat-resistant elastic layer, for example. The heat-resistant elastic layer may cover a surface of the metal core, for example. The heat-resistant elastic layer may include one or more of rubber materials such as silicone rubber, for example.

[Conveying Roller]

Each of the conveying rollers 61 to 68 may include a pair of rollers that face each other with corresponding one of the conveyance routes R1 to R5 in between. Each of the conveying rollers 61 to 68 may convey the print medium M that has been taken out by the feeding roller 20.

When the image is to be formed only on one side of the print medium M, i.e., only on the front surface of the print medium M, the print medium M may be conveyed by the conveying rollers 61 to 64 along the conveyance routes R1 and R2, for example. When the images are to be formed on both sides of the print medium M, i.e., on both the front surface and the back surface of the print medium M, the print medium M may be conveyed by the conveying rollers 61 to 68 along the conveyance routes R1 to R5, for example.

[Conveyance Path Switching Guide]

The conveyance path switching guides 71 and 72 each may switch a conveyance direction, of the print medium M, in which the print medium M is to be conveyed, depending on conditions such as a mode in which the image is formed on the print medium M. The mode in which the image is formed on the print medium M may include a mode in which the image is to be formed only on one side of the print medium M and a mode in which the images are to be formed on both sides of the print medium M, for example.

[2-2. Configuration of Developing Unit]

A description is given next of a detailed configuration of the developing unit 30. FIG. 4 illustrates, in an enlarged fashion, an example of a planar configuration of the developing unit 30, i.e., each of the developing units 30T, 30Y, 30M, 30C, and 30K, illustrated in FIG. 3. FIG. 5 is an enlarged diagram illustrating the planar configuration of the toner container 320 illustrated in FIG. 4.

As described above, the developing units 30T, 30Y, 30M, 30C, and 30K may have configurations similar to each other, except for having toners different in type, e.g., in color, from each other, for example. The toners of the developing units 30T, 30Y, 30M, 30C, and 30K may each be contained in the toner container 320, for example.

Referring to FIG. 4, the developing units 30T, 30Y, 30M, 30C, and 30K each may include a toner attaching section 310 and the toner container 320, for example. The developing units 30T, 30Y, 30M, 30C, and 30K may each be provided with a light source 330, for example.

[Toner Attaching Section]

The toner attaching section 310 may mainly attach the toner 322 onto an electrostatic latent image. As illustrated in FIG. 4, the toner attaching section 310 may include the photosensitive drum 312, a charging roller 313, a developing roller 314, a feeding roller 315, a developing blade 316, and a cleaning blade 317, for example.

The photosensitive drum 312, the charging roller 313, the developing roller 314, the feeding roller 315, the developing blade 316, and the cleaning blade 317 may be contained inside a housing 311, for example.

[Housing]

The housing 311 may include one or more of materials such as a metal material and a polymer material, for example. The housing 311 may have an opening 311K1 from which the photosensitive drum 312 is partially exposed, for example. The housing 311 may also have an opening 311K2 that guides light outputted from the light source 330 to the photosensitive drum 312.

[Photosensitive Drum]

The photosensitive drum 312 may mainly serve as a latent image supporting member on which the electrostatic latent image is formed and that supports the electrostatic latent image. The photosensitive drum 312 may extend in the Y-axis direction, and be rotatable around the Y-axis, i.e., a rotational axis. The photosensitive drum 312 may be an organic photoreceptor that includes a cylindrical electrically-conductive supporting body and a photoconductive layer, for example. The photoconductive layer may cover an outer peripheral surface of the electrically-conductive supporting body. The electrically-conductive supporting body may be a metal pipe that includes one or more of metal materials such as aluminum, for example. The photoconductive layer may be a stack that includes an electric charge generating layer and an electric charge transfer layer, for example. A portion of the photosensitive drum 312 may be exposed from the opening 311K1 provided in the housing 311.

[Charging Roller]

The charging roller 313 may mainly electrically charge a surface of the photosensitive drum 312. The charging roller 313 may include a metal shaft and an electrically-semiconductive layer that covers an outer peripheral surface of the metal shaft, for example. The charging roller 313 may be so pressed against the photosensitive drum 312 as to be in contact with the photosensitive drum 312. The metal shaft may include one or more of metal materials such as aluminum, for example. This feature regarding the material of the metal shaft may also apply in a similar manner hereinafter, for example. The electrically-semiconductive layer may include one or more of electrically-semiconductive rubber materials such as electrically-semiconductive epichlorohydrin rubber.

[Developing Roller]

The developing roller 314 may mainly support the toner 322 that is fed from the feeding roller 315, and mainly attach the fed toner 322 onto the electrostatic latent image formed on the surface of the photosensitive drum 312. The developing roller 314 may include a metal shaft and an electrically-semiconductive layer that covers an outer peripheral surface of the metal shaft, for example. The developing roller 314 may be so pressed against the photosensitive drum 312 as to be in contact with the photosensitive drum 312. The electrically-semiconductive layer may include one or more of electrically-semiconductive rubber materials such as electrically-semiconductive urethane rubber.

[Feeding Roller]

The feeding roller 315 may mainly feed the toner 322 to the surface of the developing roller 314. The feeding roller 315 may include a metal shaft and an electrically-semiconductive layer that covers an outer peripheral surface of the metal shaft, for example. The feeding roller 315 may be so pressed against the developing roller 314 as to be in contact with the developing roller 314. The electrically-semiconductive layer may include one or more of electrically-semiconductive materials such as an electrically-semiconductive foamed silicon sponge, for example. The feeding roller 35 that includes an electrically-semiconductive layer of an electrically-semiconductive foamed silicon sponge may be a so-called sponge roller.

[Developing Blade]

The developing blade 316 may mainly control the thickness of the toner 322 fed to the surface of the developing roller 314. The developing blade 316 may be disposed at a position away from the developing roller 314 with a predetermined distance, i.e., predetermined spacing, in between, for example. The thickness of the toner 322 may be controlled on the basis of the distance, i.e., the spacing, between the developing roller 314 and the developing blade 316. The developing blade 316 may include one or more of metal materials such as stainless steel, for example.

[Cleaning Blade]

The cleaning blade 317 may be a plate-like elastic member that mainly scrapes off a material such as unnecessary remains of the toner 322 that are present on the surface of the photosensitive drum 312. The cleaning blade 317 may extend in a direction substantially parallel to a direction in which the photosensitive drum 312 extends, for example. The cleaning blade 317 may be so pressed against the photosensitive drum 312 as to be in contact with the photosensitive drum 312. The cleaning blade 317 may include one or more of rubber materials such as urethane rubber, for example.

[Toner Container]

The toner container 320 may mainly contain the toner 322 to be used by the toner attaching section 310. The toner container 320 may be a so-called toner cartridge. In one example, the toner container 320 may include a toner containing receptacle 323 inside a housing 321 as illustrated in FIG. 5, for example. The toner 322 may be contained inside the toner containing receptacle 323, for example. In one example, the toner container 320 may include, inside the toner containing receptacle 323, a stirrer 324 and a shutter 325 together with the toner 322. It is to be noted that the toner container 320 may be detachably attached to the toner attaching section 310, for example. In one example, the toner container 320 may be detachably attached to the housing 311.

[Housing]

The housing 321 may include a material that is similar to the material of the housing 311, for example. The housing 321 may be provided with an opening 321K through which the toner 322 is fed to the toner attaching section 310, for example.

[Toner]

The type, e.g., the color, of the toner 322 contained in the toner container 320 may be as follows, for example. The toner container 320 of the developing unit 30T may contain the transparent toner, for example. The toner container 320 of the developing unit 30Y may contain the yellow toner, for example. The toner container 320 of the developing unit 30M may contain the magenta toner, for example. The toner container 320 of the developing unit 30C may contain the cyan toner, for example. The toner container 320 of the developing unit 30K may contain the black toner, for example.

[Stirrer]

The stirrer 324 may be, for example, a plate-shaped member that extends in the Y-axis direction. The stirrer 324 may rotate around a rotation shaft 324J that also extends in the Y-axis direction. The stirrer 324 may thus rotate in a rotation direction R. As a result, the toner 322 may be stirred by the stirrer 324.

[Shutter]

The shutter 325 may be movable, for example, between an open position, i.e., a position at which the shutter 325 allows the opening 321K to be open and a closed position, i.e., a position at which the shutter 325 allows the opening 321K to be closed. An example state where the shutter 325 is located at the open position is illustrated in FIG. 4. An example state where the shutter 325 is located at the closed position is illustrated in FIG. 5. The moving of the shutter 325 to the open position may allow the toner 322 to be discharged from the toner containing receptacle 323 toward a feeding direction P. Thus, the toner 322 may be fed from the toner containing receptacle 323 to the toner attaching section 310 via the opening 321K.

[Light Source]

The light source 330 may be an exposure device that mainly exposures the surface of the photosensitive drum 312 to thereby form the electrostatic latent image on the surface of the photosensitive drum 312. The light source 330 may be, for example, a light-emitting diode (LED) head, and include components such as an LED element and a lens array. The LED element and the lens array may be so disposed that the light outputted from the LED element forms an image on the surface of the photosensitive drum 312, for example.

[2-3. Operation]

A description is given next of an operation of the image forming apparatus.

As described below, the image forming apparatus may perform a developing process, a primary transfer process, a secondary transfer process, and a fixing process in this order to form an image on a surface of the print medium M, for example.

[Developing Process]

First, the print medium M contained in the tray 10 may be picked up by the feeding roller 20. The print medium M picked up by the feeding roller 20 may be conveyed by the conveying rollers 61 and 62 along the conveyance route R1 in a direction indicated by an arrow F1.

The developing process may involve the operation performed in the toner attaching section 310 of the developing unit 30T as described below. In the toner attaching section 310 of the developing unit 30T, the charging roller 313 may apply a direct-current voltage to the surface of the photosensitive drum 312 while rotating in accordance with the rotation of the photosensitive drum 312. The surface of the photosensitive drum 312 may be thereby charged evenly.

Thereafter, the light source 330 may apply light to the surface of the photosensitive drum 312 on the basis of the image data that has been supplied to the image forming apparatus from an external apparatus. The external apparatus may include one or more of apparatuses that are able to transmit image data to the image forming apparatus. Non-limiting examples of the external apparatus may include a personal computer. A surface potential in a region, of the surface of the photosensitive drum 312, on which the light is applied is thereby attenuated. An electrostatic latent image may be thus formed on the surface of the photosensitive drum 312.

In the developing unit 30T, the toner 322, i.e., the transparent toner, contained in the toner container 320 may be released toward the feeding roller 315.

The feeding roller 315 may rotate when receiving application of a voltage. The transparent toner may be thus fed from the toner container 320 to the surface of the feeding roller 315.

The developing roller 314 may rotate while being so pressed against the feeding roller 315 as to be in contact with the feeding roller 315, when receiving application of a voltage. The transparent toner fed to the surface of the feeding roller 315 may be thereby adsorbed onto the surface of the developing roller 314, whereby the transparent toner may be conveyed in accordance with the rotation of the developing roller 314. In this case, the transparent toner adsorbed onto the surface of the developing roller 314 may be partially removed by the developing blade 316, whereby the transparent toner adsorbed onto the surface of the developing roller 314 may be caused to have an even thickness.

After the photosensitive drum 312 rotates while being so pressed against the developing roller 314 as to be in contact with the developing roller 314, the transparent toner adsorbed onto the surface of the developing roller 314 may be moved onto the surface of the photosensitive drum 312. The transparent toner may be thereby attached to the surface of the photosensitive drum 312, i.e., to the electrostatic latent image.

[Primary Transfer Process]

Thereafter, in the transfer unit 40, when the driving roller 42 rotates, the driven roller 43 and the backup roller 44 may rotate in accordance with the rotation of the driving roller 42. This may cause the intermediate transfer belt 41 to travel in the direction indicated by the arrow F5.

The primary transfer process may involve application of a voltage to the primary transfer roller 45T. The primary transfer roller 45T may be so pressed against the photosensitive drum 312 as to be in contact with the photosensitive drum 312 with the intermediate transfer belt 41 in between. Hence, the transparent toner that has been attached to the surface, i.e., to the electrostatic latent image, of the photosensitive drum 312 in the foregoing developing process may be transferred onto the surface of the intermediate transfer belt 41.

Thereafter, the intermediate transfer belt 41 onto which the transparent toner has been transferred may continue to travel in the direction indicated by the arrow F5. This may allow each of the set of the developing unit 30Y and the primary transfer roller 45Y, the set of the developing unit 30M and the primary transfer roller 45M, the set of the developing unit 30C and the primary transfer roller 45C, and the set of the developing unit 30K and the primary transfer roller 45K to perform the developing process and the primary transfer process by a procedure similar to the foregoing procedure performed by the developing unit 30T and the primary transfer roller 45T. Thereby, the yellow toner, the magenta toner, the cyan toner, and the black toner may be transferred onto the surface of the intermediate transfer belt 41.

In one example, the developing unit 30Y and the primary transfer roller 45Y may transfer the yellow toner onto the surface of the intermediate transfer belt 41. The developing unit 30M and the primary transfer roller 45M may transfer the magenta toner onto the surface of the intermediate transfer belt 41. The developing unit 30C and the primary transfer roller 45C may transfer the cyan toner onto the surface of the intermediate transfer belt 41. The developing unit 30K and the primary transfer roller 45K may transfer the black toner onto the surface of the intermediate transfer belt 41.

It is to be noted that whether the developing process is actually performed by the respective developing units 30T, 30Y, 30M, 30C, and 30K and whether the primary transfer process is actually performed by the respective primary transfer rollers 45T, 45Y, 45M, 45C, and 45K may be determined depending on the color or the combination of colors that is necessary for the formation of the image.

[Secondary Transfer Process]

The print medium M may pass between the backup roller 44 and the secondary transfer roller 46 upon being conveyed along the conveyance route R1.

The secondary transfer process may involve application of a voltage to the secondary transfer roller 46. The secondary transfer roller 46 may be so pressed against the backup roller 44 as to be in contact with the backup roller 44 with the print medium M in between. Hence, the toner 322 that has been transferred onto the intermediate transfer belt 41 in the foregoing primary transfer process may be transferred onto the print medium M. The toner 322 described in the description above may be the toner 322 used in the developing process and the primary transfer process described above. In one example, the toner 322 may include one or more of the transparent toner, the yellow toner, the magenta toner, the cyan toner, and the black toner. This definition of the toner 322 may apply in a similar manner hereinafter.

[Fixing Process]

After the toner 322 has been transferred onto the print medium M in the secondary transfer process, the print medium M may be continuously conveyed along the conveyance route R1 in the direction indicated by the arrow F1. The print medium M may be thus conveyed to the fixing unit 50.

The fixing process may involve a control that is so performed as to cause the surface temperature of the heating roller 51 to be a predetermined temperature. When the pressure applying roller 52 rotates while being so pressed against the heating roller 51 as to be in contact with the heating roller 51, the print medium M may be so conveyed as to pass between the heating roller 51 and the pressure applying roller 52.

The toner 322 that has been transferred onto the surface of the print medium M may be thereby heated, which may cause the toner 322 to be molten. Further, the molten toner 322 may be so pressed against the print medium M while being applied with a pressure. This may cause the toner 322 to be firmly attached to the print medium M.

As a result, the toner 322 may be fixed to the print medium M, resulting in formation of the image on the surface on the print medium M. The print medium M on which the image has been formed may be conveyed by the conveying rollers 63 and 64 along the conveyance route R2 in a direction indicated by an arrow F2. The print medium M may thus be discharged from the discharge opening 3 to the stacker 2.

It is to be noted that the procedure of conveying the print medium M may be varied in accordance with the mode by which the image is to be formed on the surface of the print medium M.

For example, in a case where images are to be formed on both sides of the print medium M, the print medium M that has passed the fixing unit 50 may be conveyed by the conveying rollers 65 to 68 along the conveyance routes R3 to R5 in directions indicated by respective arrows F3 and F4, and be thereafter conveyed again by the conveying rollers 61 and 62 along the conveyance route R1 in the direction indicated by the arrow F1. In this case, the direction in which the print medium M is to be conveyed may be controlled by the conveyance path switching guides 71 and 72. This may allow the back surface of the print medium M, i.e., the surface on which no image has been formed yet, to be subjected to the developing process, the primary transfer process, the secondary transfer process, and the fixing process in this order.

[Cleaning Process]

Unnecessary remains of the toner 322 may sometimes be present on the surface of the photosensitive drum 312 in the developing unit 30. The unnecessary remains of the toner 322 may be a portion of the toner 322 that has been used in the primary transfer process, which may be the toner 322 that has remained on the surface of the photosensitive drum 312 without being transferred onto the intermediate transfer belt 41, for example.

To address this, the photosensitive drum 312 may rotate while being so pressed against the cleaning blade 317 as to be in contact with the cleaning blade 317 in the developing unit 30. This may cause the remains of the toner 322 present on the surface of the photosensitive drum 312 to be scraped off by the cleaning blade 317. As a result, the unnecessary remains of the toner 322 may be removed from the surface of the photosensitive drum 312.

Further, in the transfer unit 40, a portion of the toner 322 that has been moved onto the surface of the intermediate transfer belt 41 in the primary transfer process may sometimes not be moved onto the surface of the print medium M in the secondary transfer process and may remain on the surface of the intermediate transfer belt 41.

To address this, the cleaning blade 47 may scrape off the remains of the toner 322 present on the surface of the intermediate transfer belt 41 in the transfer unit 40 upon traveling of the intermediate transfer belt 41 in the direction indicated by the arrow F5. As a result, unnecessary remains of the toner 322 may be removed from the surface of the intermediate transfer belt 41.

[2-4. Workings and Effects]

In this image forming apparatus, the toner 322 having a configuration similar to that of the toner according to an example embodiment of the technology described above may be used. Thus, as described above, the glossiness of an image formed by the use of the toner 322 may improve while the bias responsiveness of the toner 322 is ensured. Accordingly, an image that excels in glossiness may be formed by the use of the toner 322 in a necessary and sufficient amount, and thus it is possible to form a high-quality image. The workings and effects described above may be obtained in a similar manner in each of the toner container 320 and the developing unit 30 in which the toner 322 is used.

Workings and effects aside from the above may be similar to those of the toner according to an example embodiment of the technology described above.

3. MODIFICATION EXAMPLES

The configuration of the image forming apparatus described above may be modified where appropriate.

For example, five types of toners 322, i.e., the transparent toner, the yellow toner, the magenta toner, the cyan toner, and the black toner, may be used in the example described above. The types of the toners 322, however, may be modified as desired. For example, the number of the colors of the toners 322 or the color combinations of the toners 322 may be modified as desired.

For example, among the five types of toners 322 described above, any one to four toners 322 may be used. One type of toner 322 may be selected as desired from among the five types of toners 322. A combination of two to four types of toners 322 may be set as desired.

In addition, for example, another toner 322 such as a white toner may be added. It is to be noted that, even in a case where another toner 322 is added, the number of the types of all the toners 322 including the added toner 322 may be one or more, and the stated number is not particularly limited. In one example, five types of toners 322, e.g., the transparent toner, the yellow toner, the magenta toner, the cyan toner, and the white toner, may be used. In another example, six types of toners 322, e.g., the transparent toner, the yellow toner, the magenta toner, the cyan toner, the black toner, and the white toner, may be used.

Working Examples

A detailed description is provided below of Examples of one example embodiment of the technology.

Examples 1 to 8

A transparent toner was fabricated by the use of a solution suspension method. An image was thereafter formed by using an image forming apparatus in which the fabricated transparent toner was provided, and various characteristics pertaining to the transparent toner were evaluated, by the following procedures.

[Fabricating of Transparent Toner]

To fabricate the transparent toner, first, a continuous phase was prepared.

In this case, first, 11,024 parts by weight of a suspension stabilizer, which was industrial sodium phosphate tribasic dodecahydrate, was mixed into 322,680 parts by weight of an aqueous solvent, which was pure water, and this mixture was then stirred at a temperature of 60° C. This caused the suspension stabilizer to dissolve, and thus a first aqueous solution was obtained. Thereafter, dilute nitric acid for regulating pH was added to the first aqueous solution.

Thereafter, 5,219 parts by weight of a suspension stabilizer, which was industrial calcium chloride anhydrous, was mixed into 43,230 parts by weight of an aqueous solvent, which was pure water, and the mixture was then stirred. This caused the suspension stabilizer to dissolve, and thus a second aqueous solution was obtained.

Thereafter, the first aqueous solution and the second aqueous solution were mixed together, and this mixture was then stirred by the use of a stirrer at a temperature of 60° C. The stirrer used was a line mill available from PRIMIX Corporation, Hyogo, Japan. The number of rotations in the stirring was 3,566 rotations per minute, and the stirring time was 50 minutes. Thus, the continuous phase was obtained.

Thereafter, a dispersed phase was prepared.

In this case, first, an organic solvent, which was ethyl acetate at a temperature of 50° C., was prepared. Thereafter, 1,397 parts by weight of a release agent, which was paraffin wax, and 36.32 parts by weight of a fluorescent brightener were mixed in this order into 76,566 parts by weight of the organic solvent, and the mixture was then stirred. Thereafter, 17,182 parts by weight of a binder resin, which was crystalline polyester-based resin, was mixed into the stated mixture, and the resulting mixture was stirred until solid matter disappeared. Thus, the dispersed phase was obtained.

Thereafter, granulation was performed by the use of the continuous phase and the dispersed phase to fabricate a toner base particle.

In this case, the dispersed phase was mixed into the continuous phase, and the mixture was then stirred at a temperature of 55° C. by the use of the stirrer described above. The number of rotations in the stirring was 1,200 rotations per minute, and the stirring time was 50 minutes. This caused the mixture to be suspended and granulated, and thus a slurry solution including the granulated product was obtained. Thereafter, the slurry solution was distilled under a reduced pressure, and thus the organic solvent, i.e., ethyl acetate, included in the slurry solution was volatilized and removed.

Thereafter, a pH regulator, which was nitric acid, was added to the slurry solution, and the slurry solution was then filtered to dissolve and remove the suspension stabilizer. Thereafter, the granulated product included in the slurry solution was then dehydrated, and the granulated product was redispersed in an aqueous solvent, which was pure water. Thereafter, the granulated product was washed with an aqueous solvent, which was pure water, and the granulated product was then filtered. Thereafter, the granulated product was dehydrated and dried, and the granulated product was thereafter classified. Thus, the toner base particle was obtained.

Lastly, the toner base particle was subjected to an external addition process to fabricate the transparent toner.

In this case, an external additive particle was mixed into 500 parts by weight of the toner base particle, and the mixture was thereafter stirred by the use of a stirrer. The stirrer used was a HENSCHEL™ mixer available from Nippon Coke & Engineering Co., Ltd., Tokyo, Japan. The number of rotations in the stirring was 5,400 rotations per minute, and the stirring time was 10 minutes.

As the external additive particle, a complex oxide particle containing a titanium dioxide and a silicon dioxide and having a mean primary particle size of 18 nm was used. This complex oxide particle used was an oxide particle with the trade name STX801 available from Nippon Aerosil Co., Ltd., Tokyo, Japan. This complex oxide particle included a center portion containing a titanium dioxide and a cover portion containing a silicon dioxide. The proportion of the weight of the center portion with respect to the overall weight of the complex oxide particle was about 85%, and the proportion of the weight of the cover portion with respect to the overall weight of the complex oxide particle was about 15%.

In the external addition process, the mixture ratio, i.e., the weight ratio, between the toner base particle and the external additive particle was so adjusted as to cause the weight rate W (%) to be a predetermined value. Details of the weight rate W are as summarized in Table 1. Thus, the external additive particle was attached to the surface of the toner base particle, and the transparent toner was thus completed. In other words, a plurality of types of transparent toners having mutually different weight rates W were obtained.

For a comparison, another transparent toner was fabricated by a similar procedure except that no external additive particle, i.e., no complex oxide particle, was used.

Here, the surfaces of the series of transparent toners were subjected to an elementary analysis by the use of the EDX, and the detection amount of titanium was measured in terms of its percentage by weight. Then, the results summarized in Table 1 were obtained. Details of the procedures of the elementary analysis in which the EDX is used are as described above.

In addition, the transmittances (%) of the series of transparent toners were measured, and the obtained transmittances of the series of transparent toners were all equal to or higher than 80%. Details of the procedures for measuring the transmittance of the transparent toner are as described above.

[Evaluation of Various Characteristics of Transparent Toner]

As the various characteristics of the series of transparent toners described above, the glossiness of an image formed by the use of the transparent toner and the bias responsiveness of the transparent toner were evaluated, and the results summarized in Table 1 were obtained.

[Procedure for Evaluating Glossiness of Image]

To evaluate the glossiness of an image, an image was formed on a surface of a print medium by the use of an image forming apparatus in which the series of transparent toners were provided, and the glossiness of the surface of the print medium on which the image has been formed was measured thereafter.

In this case, a color printer, which was an LED color printer with the trade name C941 available from Oki Data Corporation, Tokyo, Japan, was used as the image forming apparatus. Plain paper of A4 size, which was glossy paper with the trade name "Excellent Gloss" available from Oki Data Corporation, Tokyo, Japan, was used as the print medium. The type of the image formed by the use of the image forming apparatus was a continuous image. To form this continuous image, the fixing amount of the transparent toner to be fixed to the surface of the print medium was set to 0.45 mg/cm2. To measure the gloss value, a glossmeter, which was a precision glossmeter with the trade name GM-26D available from Murakami Color Research Laboratory, Tokyo, Japan, was used, and the measurement angle was set to 75°.

The glossiness of the image was evaluated on two scales on the basis of the result of measuring the gloss value. Specifically, in a case where the gloss value was lower than 83, the glossiness of the image was insufficient at a visual inspection level and was given a "C" rating. In contrast, in a case where the gloss value was equal to or higher than 83, the glossiness of the image was sufficient as a visual inspection level and was given an "A" rating. The threshold value of 83 used as an evaluation standard in this case is a threshold value of the gloss value that allows the quality of the glossiness of the image to be determined sufficiently through visual inspection.

[Procedure for Evaluating Bias Responsiveness of Transparent Toner]

To evaluate the bias responsiveness of the transparent toner, a voltage application condition was varied during formation of the solid image described above, and variation in the attachment amount ($mg/cm^2$) of the transparent toner attached to the surface of the developing roller was examined.

Specifically, first, an attachment amount A1 of the transparent toner attached on the surface of the developing roller was measured under the following condition: the voltage applied to the developing roller was −200 V, and the voltage applied to the feeding roller was −240 V. Here, the difference between the voltages was −40 V. Thereafter, with the voltage applied to the developing roller unchanged, the voltage applied to the feeding roller was varied from −240 V to −340 V, resulting in a difference between the voltages of −140 V, and an attachment amount A2 of the transparent toner attached to the surface of the developing roller was then measured. Lastly, a variation ratio A between the attachment amounts of the transparent toner was calculated. This variation ratio A was calculated from an equation A=A2/A1.

The bias responsiveness of the transparent toner was evaluated on two scales on the basis of the result of calculating the variation ratio A. Specifically, in a case where the variation ratio A was lower than 1.1, it was not possible to sufficiently vary the amount of electric charge and the attachment amount of the transparent toner in accordance with variation in the voltage, and thus this case was given a "C" rating. In contrast, in a case where the variation ratio A was equal to or higher than 1.1, it was possible to sufficiently vary the amount of electric charge and the attachment amount of the transparent toner in accordance with variation in the voltage, and thus this case was given an "A" rating. The threshold value of 1.1 used as the evaluation standard in this case was a threshold value of the variation ratio corresponding to variation in the minimum required attachment amount for controlling the amount of electric charge and the attachment amount of the transparent toner with high accuracy.

[Overall Evaluation]

The overall performance of the transparent toner was evaluated on the basis of the evaluation result of the glossiness of the image and the evaluation result of the bias responsiveness of the transparent toner described above. Specifically, in a case where either of the evaluation result of the glossiness of the image and the evaluation result of the bias responsiveness of the transparent toner was "C", it was not possible to achieve both the glossiness and the bias responsiveness, and thus an overall rating of "C" was given. Meanwhile, in a case where both the evaluation result of the glossiness of the image and the evaluation result of the bias responsiveness of the transparent toner were "A", it was possible to achieve both the glossiness and the bias responsiveness, and thus an overall rating of "A" was given.

TABLE 1

| Example | Weight rate W (wt %) | Titanium detection amount (wt %) | Gloss-iness | Bias responsiveness | Overall evaluation |
|---|---|---|---|---|---|
| 1 | 0 | 0 | C | A | C |
| 2 | 0.5 | 0.203 | C | A | C |
| 3 | 1.0 | 0.384 | C | A | C |
| 4 | 1.5 | 0.580 | C | A | C |
| 5 | 1.6 | 0.590 | A | A | A |
| 6 | 2.0 | 0.805 | A | A | A |
| 7 | 2.5 | 0.967 | A | A | A |
| 8 | 3.0 | 1.202 | A | C | C |

As summarized in Table 1, each of the glossiness of the image and the bias responsiveness of the transparent toner greatly varied in accordance with the detection amount of titanium.

Specifically, in a case where the detection amount of titanium was equal to or lower than 0.580 wt %, i.e., in Examples 1 to 4, sufficient glossiness was not obtained. In contrast, in a case where the detection amount of titanium was equal to or higher than 0.590 wt %, i.e., in Examples 5 to 8, sufficient glossiness was obtained.

Meanwhile, in a case where the detection amount of titanium was equal to or higher than 1.202 wt %, i.e., in Example 8, sufficient bias responsiveness was not obtained. In contrast, in a case where the detection amount of titanium was equal to or lower than 0.967 wt %, i.e., in Examples 1 to 7, sufficient bias responsiveness was obtained.

Thus, as apparent from the overall evaluation, when the detection amount of titanium was from 0.590 wt % to 0.967 wt %, i.e., in Examples 5 to 7, sufficient glossiness was obtained, and sufficient bias responsiveness was also obtained. The weight rate W in this case was from 1.6 wt % to 2.5 wt %.

On the basis of these results, on a condition that the external additive particle of the toner was a complex oxide that contained a titanium dioxide and a silicon dioxide and the element detection condition of the external additive particle described above was satisfied, the glossiness of the image improved, and the bias responsiveness of the toner used to form that image also improved. In other words, on a condition that the external additive particle of the toner contained a titanium dioxide and a silicon dioxide and the detection amount of titanium was from 0.590 wt % to 0.967 wt %, the glossiness of the image improved, and the bias responsiveness of the toner used to form that image also improved. Accordingly, it is possible to form a high-quality by forming an image by the use of the toner.

The technology has been described above referring to the example embodiments and the modification examples thereof; however, the technology is not limited to the example embodiments and the modification examples described above, and is modifiable in various ways.

For example, the image forming scheme of the image forming apparatus is not limited to the intermediate-transfer scheme in which an intermediate transfer medium is used as described above and may be a direct-transfer scheme in which an intermediate transfer medium is not used. In the direct-transfer scheme, a toner attached to an electrostatic latent image is directly transferred onto a surface of a print medium in an image forming process.

In addition, for example, the image forming apparatus is not limited to a printer as described above and may be another apparatus such as a copying machine, a facsimile, or a multi-functional apparatus.

Furthermore, the technology encompasses any possible combination of some or all of the various embodiments and the modifications described herein and incorporated herein.

It is possible to achieve at least the following configurations from the above-described example embodiments of the technology.

(1) A toner, including:
- an external additive particle that is a complex oxide containing a titanium dioxide ($TiO_2$) and a silicon dioxide ($SiO_2$), wherein
- a detection amount of titanium (Ti) detected through an elementary analysis based on energy-dispersive X-ray spectrometry is equal to or higher than about 0.590 percent by weight and equal to or lower than about 0.967 percent by weight.

(2) The toner according to (1), in which
- the external additive particle includes
  - a center portion that contains the titanium dioxide, and
  - a cover portion that covers a surface of the center portion and contains the silicon dioxide.

(3) The toner according to (1) or (2), further including
- a toner base particle that contains a binder resin and to which the external additive particle is attached, in which
- a rate of a weight of the external additive particle relative to a weight of the toner base particle is equal to or higher than about 1.6 percent by weight and equal to or lower than about 2.5 percent by weight.

(4) The toner according to any one of (1) to (3), in which the toner is a transparent toner.

(5) The toner according to (4), in which a transmittance at time when the toner is irradiated with test light in a state in which the toner is attached to a surface of a substrate is equal to or higher than about 80 percent under a test condition in which the substrate is an overhead projector film CG 3700 available from 3M, St. Paul, Minn., USA, an attachment amount of the toner is 0.70 milligram per square centimeter, and a wavelength of the test light is equal to or longer than 430 nanometers and equal to or shorter than 740 nanometer.

(6) A toner container, including:
- a toner including an external additive particle that is a complex oxide containing a titanium dioxide and a silicon dioxide; and
- a toner containing receptacle that contains the toner, in which
- a detection amount of titanium detected through an elementary analysis, of the toner, based on energy-dispersive X-ray spectrometry is equal to or higher than about 0.590 percent by weight and equal to or lower than about 0.967 percent by weight.

(7) A developing unit, including:
- a toner container that contains a toner, the toner including an external additive particle that is a complex oxide containing a titanium dioxide and a silicon dioxide; and
- a toner attaching section that attaches the toner contained in the toner container to a latent image, in which
- a detection amount of titanium detected through an elementary analysis, of the toner, based on energy-dispersive X-ray spectrometry is equal to or higher than about 0.590 percent by weight and equal to or lower than about 0.967 percent by weight.

(8) An image forming apparatus, including:
- a developing unit that includes a toner container and a toner attaching section, the toner container containing a toner, the toner attaching section attaching the toner contained in the toner container to a latent image, the toner including an external additive particle that is a complex oxide containing a titanium dioxide and a silicon dioxide;
- a transfer unit that transfers, onto a print medium, the toner attached to the latent image by the developing unit; and
- a fixing unit that fixes, to the print medium, the toner transferred onto the print medium by the transfer unit, in which
- a detection amount of titanium detected through an elementary analysis, of the toner, based on energy-dispersive X-ray spectrometry is equal to or higher than about 0.590 percent by weight and equal to or lower than about 0.967 percent by weight.

According to the toner, the toner container, the developing unit, or the image forming apparatus of one embodiment of the technology, the external additive particle is a complex oxide that contains a titanium dioxide and a silicon dioxide, and the detection amount of titanium detected through an elementary analysis of the toner performed by the use of the EDX is equal to or higher than about 0.590 wt % and equal to or lower than about 0.967 wt %. Accordingly, it is possible to form a high-quality image.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A toner, comprising:

an external additive particle that is a complex oxide containing a titanium dioxide ($TiO_2$) and a silicon dioxide ($SiO_2$), wherein a detection amount of titanium (Ti) detected through an elementary analysis based on energy-dispersive X-ray spectrometry is equal to or higher than 0.590 percent by weight and equal to or lower than 0.967 percent by weight.

2. The toner according to claim 1, wherein the external additive particle includes a center portion that contains the titanium dioxide, and a cover portion that covers a surface of the center portion and contains the silicon dioxide.

3. The toner according to claim 1, further comprising a toner base particle that contains a binder resin and to which the external additive particle is attached, wherein a rate of a weight of the external additive particle relative to a weight of the toner base particle is equal to or higher than 1.6 percent by weight and equal to or lower than 2.5 percent by weight.

4. The toner according to claim 1, wherein the toner is a transparent toner.

5. A toner container, comprising:

the toner according to claim 1; and a toner containing receptacle that contains the toner.

6. A developing unit, comprising:

a toner container that contains the toner according to claim 1; and a toner attaching section that attaches the toner contained in the toner container to a latent image.

7. An image forming apparatus, comprising:

a developing unit that includes a toner container and a toner attaching section, the toner container containing the toner according to claim 1, the toner attaching section attaching the toner contained in the toner container to a latent image;

a transfer unit that transfers, onto a print medium, the toner attached to the latent image by the developing unit; and a fixing unit that fixes, to the print medium, the toner transferred onto the print medium by the transfer unit.

* * * * *